US005975554A

United States Patent [19]

Linton

[11] Patent Number: 5,975,554

[45] Date of Patent: Nov. 2, 1999

[54] QUICK ADJUSTMENT BOOT SECUREMENT DEVICE FOR A SNOWBOARD

[76] Inventor: Stanley D. Linton, 310 Healy, Romeoville, Ill. 60446

[21] Appl. No.: 08/891,274

[22] Filed: Jul. 10, 1997

[51] Int. Cl.[6] ..... A63C 9/00

[52] U.S. Cl. ..... 280/607; 280/618; 280/633; 280/14.2

[58] Field of Search ..... 280/607, 611, 280/618, 620, 623, 11.36, 14.7, 14.1, 629, 630, 633, 636, 634; 441/70

[56] References Cited

U.S. PATENT DOCUMENTS

| | | | |
|---|---|---|---|
| 5,028,068 | 7/1991 | Donovan | 280/14.2 |
| 5,044,654 | 9/1991 | Meger | 280/14.2 |
| 5,236,216 | 8/1993 | Ratzel | 280/14.2 |
| 5,499,837 | 3/1996 | Hale et al. | 280/14.2 |
| 5,520,405 | 5/1996 | Boenke | 280/14.2 |
| 5,553,883 | 9/1996 | Erb | 280/14.2 |
| 5,667,237 | 9/1997 | Lauer | 280/14.2 |
| 5,871,226 | 2/1999 | Klabitschko et al. | 280/14.2 |
| 5,876,045 | 3/1999 | Aunna Jr. | 280/14.2 |

*Primary Examiner*—Richard M. Camby

[57] ABSTRACT

A quick adjustment boot securement device for a snowboard is provided including a base coupled to the top of the snowboard. A boot binding housing is included with a bore that is adapted to rotatably receive the base therein. Next provided is a boot binding assembly including a floating clamp having a U-shaped configuration. The boot binding assembly further includes a clamping mechanism for engaging the clamp with the base thereby precluding rotation of the boot binding housing with respect to the snowboard.

1 Claim, 2 Drawing Sheets

QUICK ADJUSTMENT BOOT SECUREMENT DEVICE FOR A SNOWBOARD

BACKGROUND OF THE INVENTION

1. Field of the Invention

The present invention relates to a quick adjustment boot securement device for a snowboard and more particularly pertains to allowing quick and convenient rotation of a boot binding mechanism on a snowboard.

2. Description of the Prior Art

The use of rotatable boot binding mechanisms is known in the prior art. More specifically, rotatable boot binding mechanisms heretofore devised and utilized for the purpose of allowing rotation of a boot binder with respect to a snowboard are known to consist basically of familiar, expected and obvious structural configurations, notwithstanding the myriad of designs encompassed by the crowded prior art which have been developed for the fulfillment of countless objectives and requirements.

By way of example, the prior art includes U.S. Pat. No. 5,236,216 to Ratzek; U.S. Pat. No. 5,028,068 to Donovan; U.S. Pat. No. 4,728,116 to Hill; U.S. Pat. No. 5,054,807 to Fauvet; U.S. Pat. No. 5,021,017 to Ott; and U.S. Patent Des. 357,296 to Sims.

In this respect, the quick adjustment boot securement device for a snowboard according to the present invention substantially departs from the conventional concepts and designs of the prior art, and in so doing provides an apparatus primarily developed for the purpose of allowing quick rotation of a boot binding mechanism on a snowboard.

Therefore, it can be appreciated that there exists a continuing need for a new and improved quick adjustment boot securement device for a snowboard which can be used for allowing quick rotation of a boot binding mechanism on a snowboard. In this regard, the present invention substantially fulfills this need.

SUMMARY OF THE INVENTION

In view of the foregoing disadvantages inherent in the known types of rotatable boot binding mechanisms now present in the prior art, the present invention provides an improved quick adjustment boot securement device for a snowboard. As such, the general purpose of the present invention, which will be described subsequently in greater detail, is to provide a new and improved quick adjustment boot securement device for a snowboard which has all the advantages of the prior art and none of the disadvantages.

To attain this, the present invention essentially comprises a base with a lower extent having a disk shaped configuration. As shown in FIG. 4, a circumferential periphery of the base is equipped with a plurality of vertical teeth integrally formed therein. Such base further has an upper extent formed of an inverted frusto-conical member integrally coupled in coaxial alignment with the lower extent. With reference still to FIG. 4, it can be seen that the upper extent has an upper circumference which is greater than that of the lower extent. At least one vertical bore is formed through the entire base for allowing the coupling of the base to the top face of the snowboard via a pair of bolts. Next provided is a boot binding housing with a generally rectangular configuration. The housing has a top face, a bottom face, and a periphery formed therebetween. As shown in FIG. 4, the bottom face of the housing comprises a bore with an upper extent having an inverted frusto-conical configuration and a lower extent having a disk shaped configuration. The lower extent of the bore has a rear periphery including a diameter equal to that of the lower extent of the base. Further, the lower extent of the bore has a plurality of vertical teeth integrally formed therein. The upper and lower extent of the bore of the housing further has a front periphery with a U-shaped cut out. It is imperative that the Ushaped cut out define a diameter greater than that of the rear periphery of the lower extent. For allowing the coupling of a standard boot thereto, the boot binding housing further includes a boot slot formed on the top face thereof. The boot slot is defined by a U-shaped cup with a vertically extending tab integrally coupled to an apex thereof and extended upwardly therefrom. By this structure, the upper and lower extent of the base are rotatably positioned within the upper and lower extent of the bore of the housing. Also included is a boot binding assembly having a floating clamp. Note FIGS. 2 & 3. Such floating clamp has a U-shaped configuration with an inner surface having a diameter equal to that of the lower extent of the base and a plurality of vertical teeth formed therein. The floating clamp is situated within the U-shaped cut out of the front periphery of the bore of the housing during use. A pair of springs are positioned at ends of the floating clamp for biasing the floating clamp away from the teeth of the base. This allows rotation of the boot binding housing with respect to the base. Note FIG. 3. The boot binding assembly further includes a cable positioned about an outer surface of the floating clamp. Such cable is adapted for biasing the floating clamp toward the base thereby locking the teeth of the inner surface of the floating clamp with the teeth of the base thereby precluding rotation.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved quick adjustment boot securement device for a snowboard which has all the advantages of the prior art rotatable boot binding mechanisms and none of the disadvantages.

It is another object of the present invention to provide a new and improved quick adjustment boot securement device for a snowboard which may be easily and efficiently manufactured and marketed.

It is a further object of the present invention to provide a new and improved quick adjustment boot securement device for a snowboard which is of a durable and reliable construction.

An even further object of the present invention is to provide a new and improved quick adjustment boot securement device for a snowboard which is susceptible of a low cost of manufacture with regard to both materials and labor, and which accordingly is then susceptible of low prices of sale to the consuming public, thereby making such quick adjustment boot securement device for a snowboard economically available to the buying public.

Still yet another object of the present invention is to provide a new and improved quick adjustment boot securement device for a snowboard which provides in the apparatuses and methods of the prior art some of the advantages thereof, while simultaneously overcoming some of the disadvantages normally associated therewith.

Still another object of the present invention is to allow quick rotation of a boot binding mechanism on a snowboard.

Lastly, it is an object of the present invention to provide a new and improved quick adjustment boot securement device for a snowboard is provided including a base coupled to the top of the snowboard. A boot binding housing is included with a bore that is adapted to rotatably receive the base therein. Next provided is a boot binding assembly including a floating clamp having a U-shaped configuration. The boot binding assembly further includes a clamping mechanism for engaging the clamp with the base thereby precluding rotation of the boot binding housing with respect to the snowboard.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

Similar reference characters refer to similar parts throughout the several views of the drawings.

DESCRIPTION OF THE PREFERRED EMBODIMENT

Figure 1:
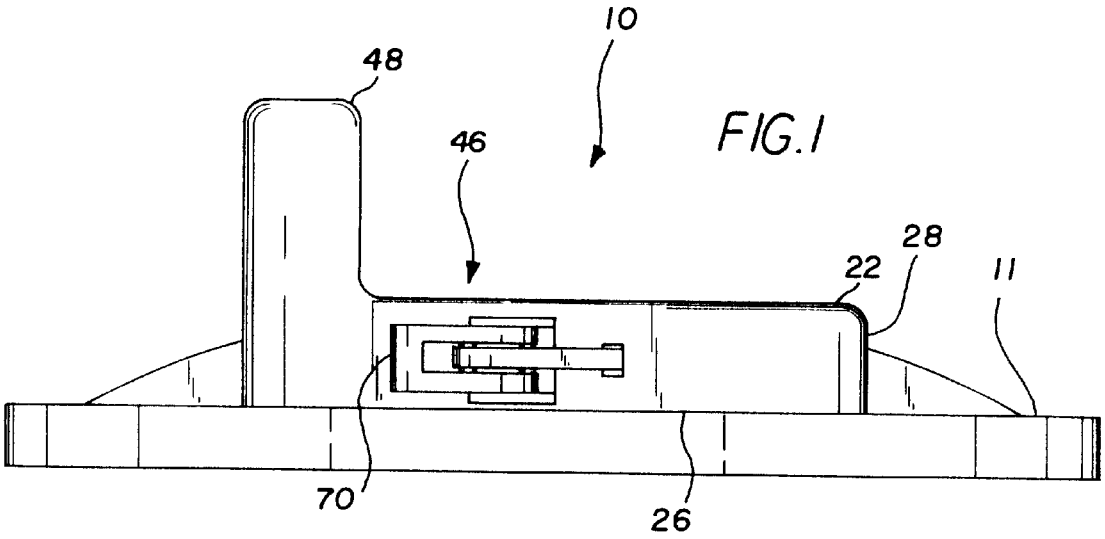
FIG. 1 is a perspective illustration of the preferred embodiment of the quick adjustment boot securement device for a snowboard constructed in accordance with the principles of the present invention.

With reference now to the drawings, and in particular to FIG. 1 thereof, a new and improved quick adjustment boot securement device for a snowboard embodying the principles and concepts of the present invention and generally designated by the reference numeral 10 will be described.

The present invention, the new and improved quick adjustment boot securement device for a snowboard, is comprised of a plurality of components. Such components in their broadest context include a snowboard, base, boot binding housing, and boot binding assembly. Such components are individually configured and correlated with respect to each other so as to attain the desired objective.

Figure 4:
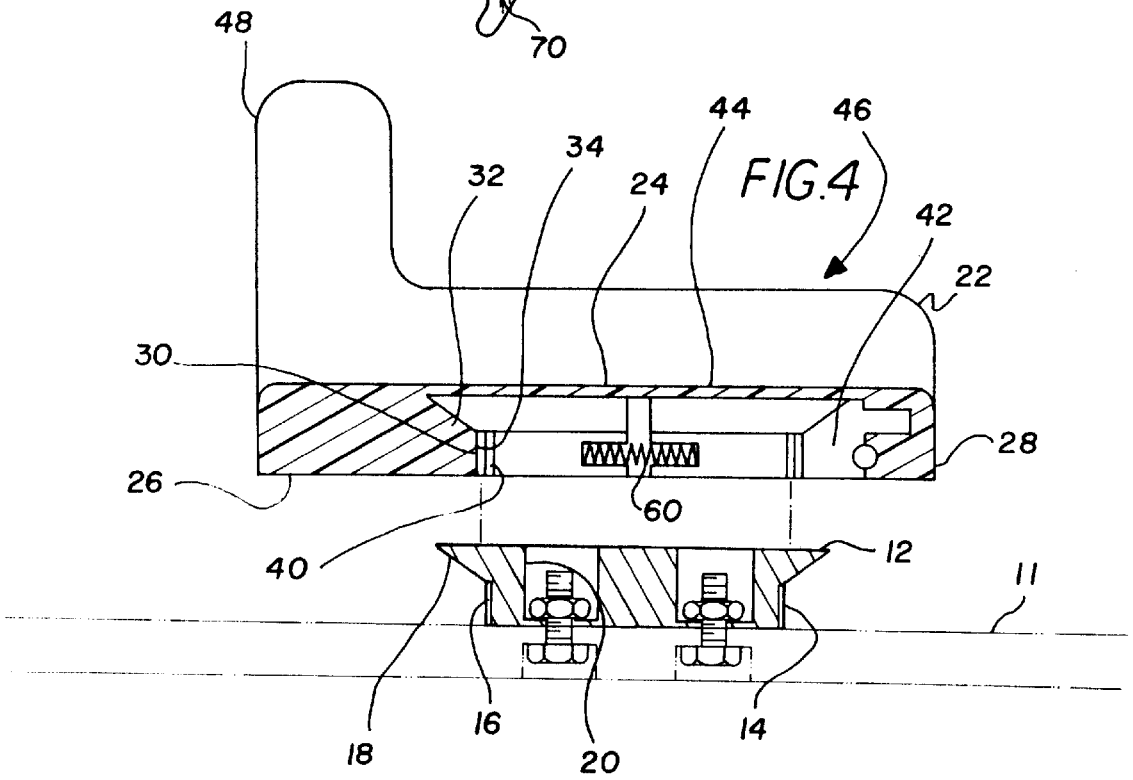
FIG. 4 is a cross-sectional view of the boot binding assembly and housing.

More specifically, it will be noted that the system 10 of the present invention is intended for use with a snowboard 11 having a top face and a bottom face. Note FIG. 1. The invention includes a base 12 with a lower extent 14 having a disk shaped configuration. As shown in FIG. 4, a circumferential periphery of the lower extent base is equipped with a plurality of vertical teeth 16 integrally formed therein. Such base further has an upper extent 18 formed of an inverted frusto-conical member integrally coupled in coaxial alignment with the lower extent. With reference still to FIG. 4, it can be seen that the upper extent has an upper circumference which is greater than that of the lower extent. At least one vertical bore 20 is formed through the entire base for allowing the coupling thereof to the top face of the snowboard via a pair of bolts.

Next provided is a boot binding housing 22 with a generally rectangular configuration. The housing has a top face 24, a bottom face 26, and a periphery 28 formed therebetween. As shown in FIG. 4, the bottom face of the housing comprises a bore 30 with an upper extent 32 having an inverted frusto-conical configuration and a lower extent 34 having a disk shaped configuration. As shown in FIG. 4, the upper extent of the bore is provided with a cover formed integral with the housing for preventing snow, dirt, and the like from entering the bore.

The lower extent of the bore has a rear periphery 36 including a diameter equal to that of the lower extent of the base. Further, the lower extent of the bore has a plurality of vertical teeth 40 integrally formed therein. The upper and lower extent of the bore of the housing further has a front periphery with a U-shaped cut out 42. It is imperative that the U-shaped cut out define a compartment with an outer diameter greater than that of the rear periphery of the lower extent of the bore. By this structure, the upper and lower extent of the base are rotatably positioned within the upper and lower extent of the bore of the housing. In such operative orientation, the bottom face of the housing sits flush with the top surface of the snowboard.

For allowing the coupling of a standard boot thereto, the boot binding housing further includes a boot slot 44 formed on the top face thereof. The boot slot is defined by a U-shaped cup 46 with a vertically extending tab 48 integrally coupled to an apex thereof and extended upwardly therefrom. As an option, a strap may be utilized to maintain the boot within the boot cup.

Figure 2:
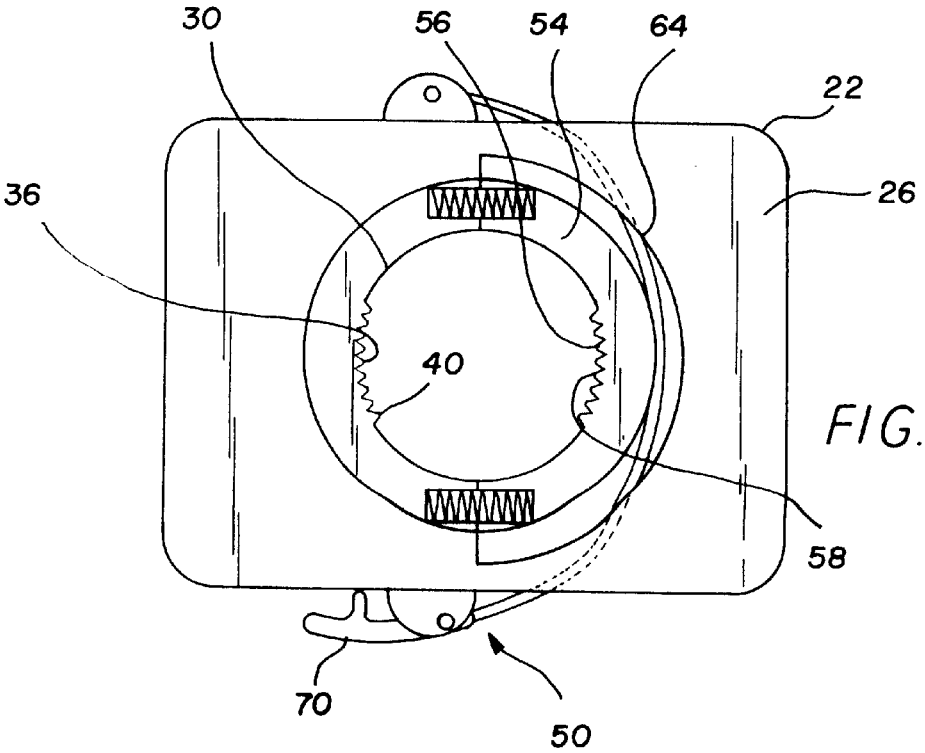
FIG. 2 is a bottom view of the boot binding assembly in an engaged orientation.
Figure 3:
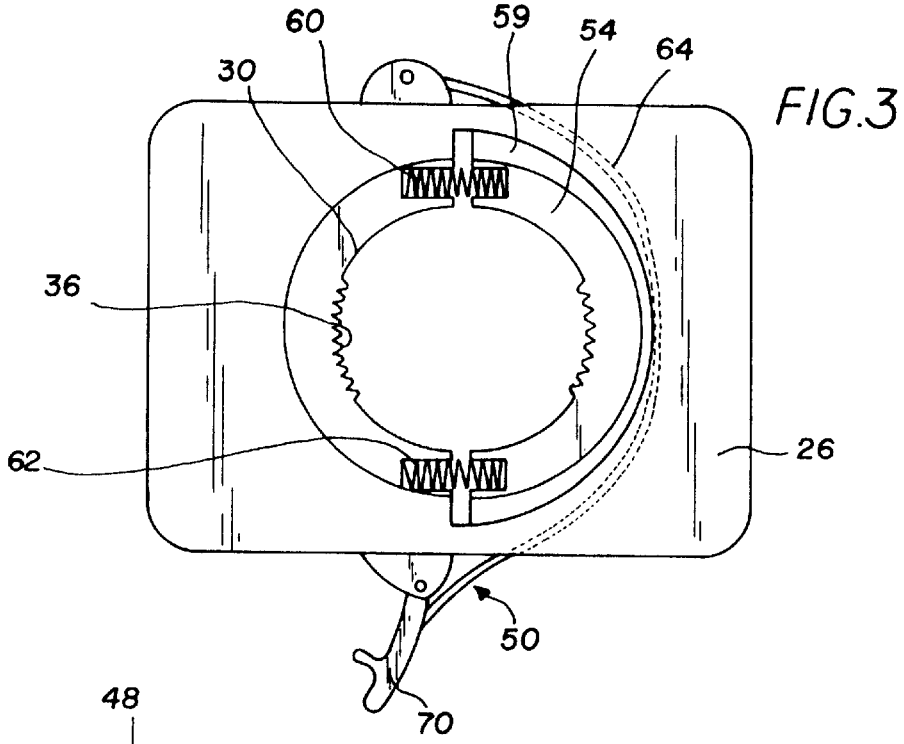
FIG. 3 is a bottom view of the boot binding assembly in a disengaged orientation.

Also included is a boot binding assembly 50 having a floating clamp 54. Note FIGS. 2 & 3. Such floating clamp has a U-shaped configuration with an inner surface 56 having a diameter equal to that of the lower extent of the base and a plurality of vertical teeth 58 formed therein. The floating clamp is situated within the U-shaped cut out of the front periphery of the bore of the housing during use. As an option, an outer periphery of the floating clamp may be equipped with a tab 59 which is adapted to be inserted within a slot formed in the housing for guiding purposes. Note FIG. 4.

A pair of springs 60 are positioned at ends of the floating clamp for biasing the floating clamp away from the teeth of the base. This allows rotation of the boot binding housing with respect to the base. Note FIG. 3. To prevent the inadvertent removal of the springs, coaxial bore pairs 62 are formed in the floating clamp and adjacent the rear periphery of the bore of the housing. The springs reside in such bores. The boot binding assembly further includes a flexible cable 64 positioned about an outer surface of the floating clamp. Such cable is adapted for biasing the floating clamp toward the base thereby locking the teeth of the inner surface of the floating clamp with the teeth of the base thus precluding rotation. To accomplish this, the cable is attached to first side of the boot binding housing and runs through an aperture formed in the housing between the exterior and the U-shaped cut out of the front periphery of the bore of the housing. The cable is further run though another bore to the opposite side of the housing whereat it is attached to a midpoint of a lever 70 which is in turn pivotally coupled to the housing for locking the cable in place upon the pivoting thereof in a rearward direction.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved quick adjustment boot securement device for a snowboard comprising, in combination:

a snowboard having a generally planar configuration with a top face and a bottom face;

a base including a lower extent with a disk shaped configuration having a circumferential periphery with a plurality of vertical teeth integrally formed therein, an upper extent formed of an inverted frusto-conical member integrally coupled in coaxial alignment with the lower extent and further having an upper circumference which is greater than that of the lower extent, at least one vertical bore formed through the entire base for allowing the coupling of the base to the top face of the snowboard via a pair of bolts;

a boot binding housing with a generally rectangular configuration having a top face, a bottom face, and a periphery formed therebetween, the bottom face of the housing comprising a bore with an upper extent having an inverted frusto-conical configuration and a lower extent having a disk shaped configuration, the lower extent of the bore having a rear periphery including a diameter equal to that of the lower extent of the base and further having a plurality of vertical teeth integrally formed therein, the upper and lower extent of the bore of the housing further having a front periphery with a U-shaped cut out defining a diameter greater than that of the rear periphery of the lower extent, the boot binding housing further including a boot slot formed on the top face thereof, the boot slot including a U-shaped cup with a vertically extending tab integrally coupled to an apex thereof and extended upwardly therefrom, whereby the upper and lower extent of the base are rotatably positioned within the upper and lower extent of the bore of the housing, respectively;

a boot binding assembly including a floating clamp having a U-shaped configuration with an inner surface having a diameter equal to that of the lower extent of the base and a plurality of vertical teeth formed therein, the floating clamp situated within the U-shaped cut out of the front periphery of the bore of the housing with a pair of springs positioned at ends thereof for biasing the floating clamp away from the teeth of the base thereby allowing rotation of the boot binding housing with respect to the base, the boot binding assembly further including a cable positioned about an outer surface of the floating clamp for biasing the same toward the base thereby locking the teeth of the inner surface of the floating clamp with the teeth of the base thereby precluding rotation.

* * * * *